United States Patent [19]

Bianchi

[11] Patent Number: 4,551,621

[45] Date of Patent: Nov. 5, 1985

[54] FLIP-OVER MECHANISM

[75] Inventor: Julio J. Bianchi, Lanus Oeste, Argentina

[73] Assignee: General Electric Company, Somersworth, N.H.

[21] Appl. No.: 675,190

[22] Filed: Nov. 27, 1984

[51] Int. Cl.[4] ..... G06C 27/00

[52] U.S. Cl. ..... 235/117 R; 235/133 R

[58] Field of Search ..... 235/1 C, 117 R, 119, 235/122, 133 R, 136, 137, 139 R, 139 A

[56] References Cited

U.S. PATENT DOCUMENTS

| | | | |
|---|---|---|---|
| 2,661,904 | 12/1953 | Bird | 235/117 R |
| 3,116,875 | 1/1964 | Wolfenden et al. | 235/117 R X |
| 4,015,109 | 3/1977 | Deming | 235/117 R X |

*Primary Examiner*—Benjamin R. Fuller

*Attorney, Agent, or Firm*—Robert E. Brunson

[57] ABSTRACT

A flip-over mechanism for a cyclometer register includes an eccentrically balanced fly-wheel freely rotatable on a drum shaft between a driver drum and a first driven drum, each drum being marked with decimal digits 0–9. The driver drum is driven in smooth rotation by a measuring device whose measurements are to be accumulated. At a certain point in its rotation, the driver drum engages and begins rotating the fly-wheel. As the driver drum is rotated into a position at which it performs a 9-to-0 transition, the fly-wheel becomes overbalanced and rotates forward on its stored potential energy until a striker thereon engages a tooth of a first carry pinion located between the fly-wheel and the first driven drum. This applies a momentary forward tap to the first carry pinion. The tap on the carry pinion provides a substantially instantaneous carry operation to be performed in all of the driven drums which are in position to require a carry. The mass of a replaceable weight on the fly-wheel is selected to apply the correct imbalance for producing a smooth operation.

11 Claims, 5 Drawing Figures

63A
63B
23C
21C
23B
21B
73
74
76
71
23A
24
21A
83
84
87
77
78A
82A
82
81
78B
82B

FLIP-OVER MECHANISM

BACKGROUND OF THE INVENTION

The present invention relates to cyclometer registers and, more particularly, to flip-over mechanisms for cyclometer registers.

Cyclometer registers are employed in accumulating measured quantities such as, for example, distances, times and the like. For reasons of concreteness of description, the following disclosure is directed to a cyclometer register in an electric meter.

A conventional electric meter employs an aluminum disk driven as a rotor of a small induction motor at a speed proportional to the electric power being consumed. Cyclometer drums integrate the disk motion to indicate the total energy consumed thereon. Each cyclometer drum is marked with decimal digits 0 through 9. The reading of the cyclometer register is made up of the series of numerals formed by the set made up of one numeral from each of the cyclometer drums. The readings on each cyclometer drum has a significance equal to ten times the reading on its next lower-significance neighbor. The cyclometer drums of a cyclometer register may indicate, for example, tenths, units, tens and hundreds of kilowatt hours.

A least significant cyclometer drum is generally driven by the aluminum disk through suitable reduction gearing. In the above example, the least significant cyclometer drum may indicate tenths of a kilowatt hour. This cyclometer drum is called the driver drum because, apart from displaying its own data, it provides the connection for driving all of the other cyclometer drums at ratios according to their significance. These are called driven drums. A carry operation is performed by pinions disposed between each adjacent pair of cyclometer drums. Each driven drum remains stationary except during time that the next lower-significance drum driving it performs the transition from 9 to 0.

The driver drum requires a significant time to make the 9-to-0 transition. During this transition, one reading the meter may not be certain which numeral to accept from the driver drum. Furthermore, the carry operation to higher-significance drums takes the same amount of time to make the transition from one numeral to the next as does the driver drum. Uncertainty as to which numeral to accept may produce substantial errors when an attempt is made to read the meter while a transition is in progress.

One way to attempt to solve the ambiguity during transition may include employing an unbalanced fly-wheel on the drum axis. When the unbalanced fly-wheel is pushed by the driver drum, it stores potential energy which is released against the driven drums during a 9 to 0 transition. The stored potential energy helps urge the driver drum to reduce the time taken to complete the transition.

This technique has a number of drawbacks. When the potential energy in the unbalanced fly-wheel is converted to kinetic energy in the driver drum, the fly-wheel continues to oscillate about its minimum potential energy position. During such osciliation the fly wheel may strike the driver drum. This may disturb the indication provided by the driver drum. It therefore is customary to ignore the indication of the driver drum in such a system. As a result, an order of magnitude in sensitivity of indication is relinquished. That is, if the driver drum is capable of indicating 0.1 KWh, ignoring the reading on the driver drum degrades the sensitivity to 1 KWh. In addition, no provision is included for adjusting the amount of imbalance of the fly-wheel to optimize the operation of the cyclometer register.

OBJECTS AND SUMMARY OF THE INVENTION

Accordingly, it is an object of the invention to provide a flip-over mechanism for a cyclometer register which overcomes the drawbacks of the prior art.

It is a further object of the invention to provide a flip-over mechanism for a cyclometer register which includes means for rapidly incrementing the cyclometer drums of the cyclometer register during the transition of lower-significance drums.

It is a still further object of the invention to provide a flip-over mechanism having a fly-wheel with a selectable unbalanced weight disposed between a driver drum and a first driven drum. The selectability of the unbalanced weight permits adjustment of the imbalance of the fly-wheel for fine tuning the operation of the cyclometer register.

Briefly stated, the present invention provides a flip-over mechanism for a cyclometer register having an eccentrically balanced fly-wheel freely rotatable on a drum shaft between a driver drum and a first driven drum, each drum being marked with decimal digits 0–9. The driver drum is driven in smooth rotation by a measuring device whose measurement are to be accumulated. At a certain point in its rotation, the driver drum engages and begins rotating the fly-wheel. As the driver drum is rotated into a position at which it performs a 9-to-0 transition, the fly-wheel becomes overbalanced and rotates forward on its stored potential energy until a striker thereon engages a tooth of a first carry pinion located between the fly-wheel and the first driven drum. This applies a momentary forward tap to the first carry pinion. The tap on the carry pinion provides a substantially instantaneous carry operation to be performed in all of the driven drums which are in position to require a carry. The mass of a replaceable weight on the fly-wheel is selected to apply the correct imbalance for producing a smooth operation.

According to an emdobiment of the invention, there is provided a flip-over mechanism for a cyclometer register of a type including at least first and second cyclometer drums rotatable on a drum shaft and a carry pinion for incrementing the second cyclometer drum, comprising means for pemitting the first cyclometer drum to be driven by an external device, a fly-wheel on the drum shaft, means on the fly-wheel for providing a predetermined amount of imbalance therein, engaging means on the first cyclometer drum and the fly-wheel for concertedly rotating the fly-wheel by the first cyclometer drum during a predetermined portion of a rotation of the first cyclometer drum, the engaging means including means for permitting the fly wheel to perform a free forward rotation upon the shaft at a predetermined point in a rotation of the first cyclometer drum and the fly-wheel including means for momentarily urging the carry pinion at an end of the free forward rotation whereby a substantially instantaneous carry in provided.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figures 1, 3, 4, 5:
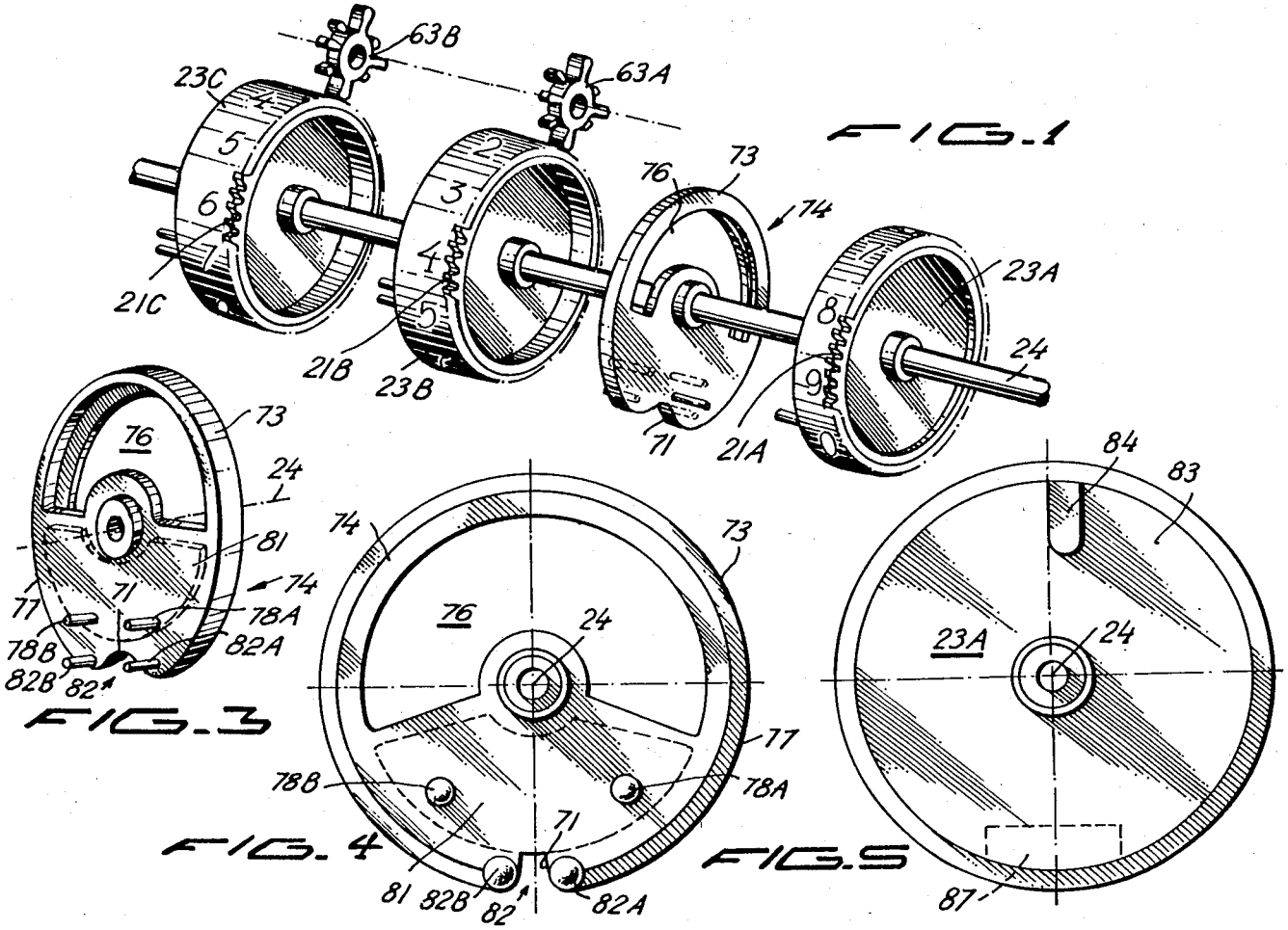
FIG. 1 is a schematic partially exploded perspective view of a flip-over mechanism according to an embodiment of the present invention.
FIG. 3 is a perspective view of the fly-wheel of FIG. 1.
FIG. 4 is an axial view of the fly-wheel as seen from the second cyclometer drum of FIG. 1.
FIG. 5 is an axial view of the driver drum, as seen from the fly-wheel of FIG. 1.

Referring to FIG. 1, a cyclometer register, shown generally at 10, includes a driver drum 23A on a drum shaft 24. A gear wheel 21A is rigidly affixed to driver drum 23A. An eccentric fly wheel 73, is freely rotatable on drum shaft 24 between driver drum 23A and a second drum 23B. A first pinion 63A on a pinion shaft 57, whose axis is identified by a dot-dash line, mechanically couples driver drum 23A to second drum 23B. Similarly, a second pinion 63B on pinion shaft 57 mechanically couples second drum 23B to a third drum 23C.

Although driver drum 23A and cyclometer drums 23B and 23C may have any appropriate calibration, for purposes of the following description, it is assumed that driver drum 23A is calibrated in tenths of kilowatt hours, whereas cyclometer drums 23B and 23C are calibrated in units and tens of kilowatt hours respectively.

Referring now to FIGS. 3, 4 and 5, a large arcuate hole 76 extends about 180 degrees in fly wheel 73. The presence of arcuate hole 76 creates a substantial imbalance in fly wheel 73. A first surface 74 of fly wheel 73, which faces second drum 23B includes pins 78A and 78B extending axially from a solid portion 77 of fly wheel 73. A tooth 84 in a face 83 of driver drum 23A engages hole 76. As driver drum 23A is rotated by the rotating disc (not shown) of the electric meter, tooth 84 engages an aligned pin 86 in the facing second side surface 75 of fly wheel 73 at a certain point in its rotation and begins rotating fly wheel 73 along with it. At a predetermined point in the rotation of fly wheel 73, its eccentric weighting causes it to become overbalanced and to freely rotate until stopped, as will be described. In the preferred embodiment, engagement between tooth 84 and pin 86 occurs at about 5 on driver drum 23A and continues until driver drum 23A passes 9. At about that time, the imbalance in fly wheel 73 permits fly wheel 73 to rotate on its own until stopped, as will be described.

A weight 81, indicated in dashed line in FIGS. 3 and 4, is removably mounted on pins 78A and 78B. Weight 81 is preferably made of a massive material such as, for example, iron. In the preferred embodiment, the mass of weight 81 is selectable from about 3 to about 6 grams. During preliminary testing, a value of weight 81 is selected to provide an imbalance of fly wheel 73 which is effective to drive all cyclometer drums either simultaneously or in a chain sequence.

Driver drum 23A, fly wheel 73, second drum 23B and first pinion 63A are preferably of a polyamide material such as, for example, a material sold under the trademark RILSAN. After the desired value of weight 81 is installed on pins 78A and 78B, the ends of pins 78A and 78B are heat rivetted to hold it in place.

Drum shaft 24 is preferably made of stainless steel with a diameter of about $\frac{1}{8}$ inch and a length of about $3\frac{3}{4}$ inch. First pinion 63A and second pinion 63B are also preferably of a polyamide material. Pinion shaft 57 is also preferably made of stainless steel with a diameter of about 2 mm and a length of about 79 mm.

Figure 2:
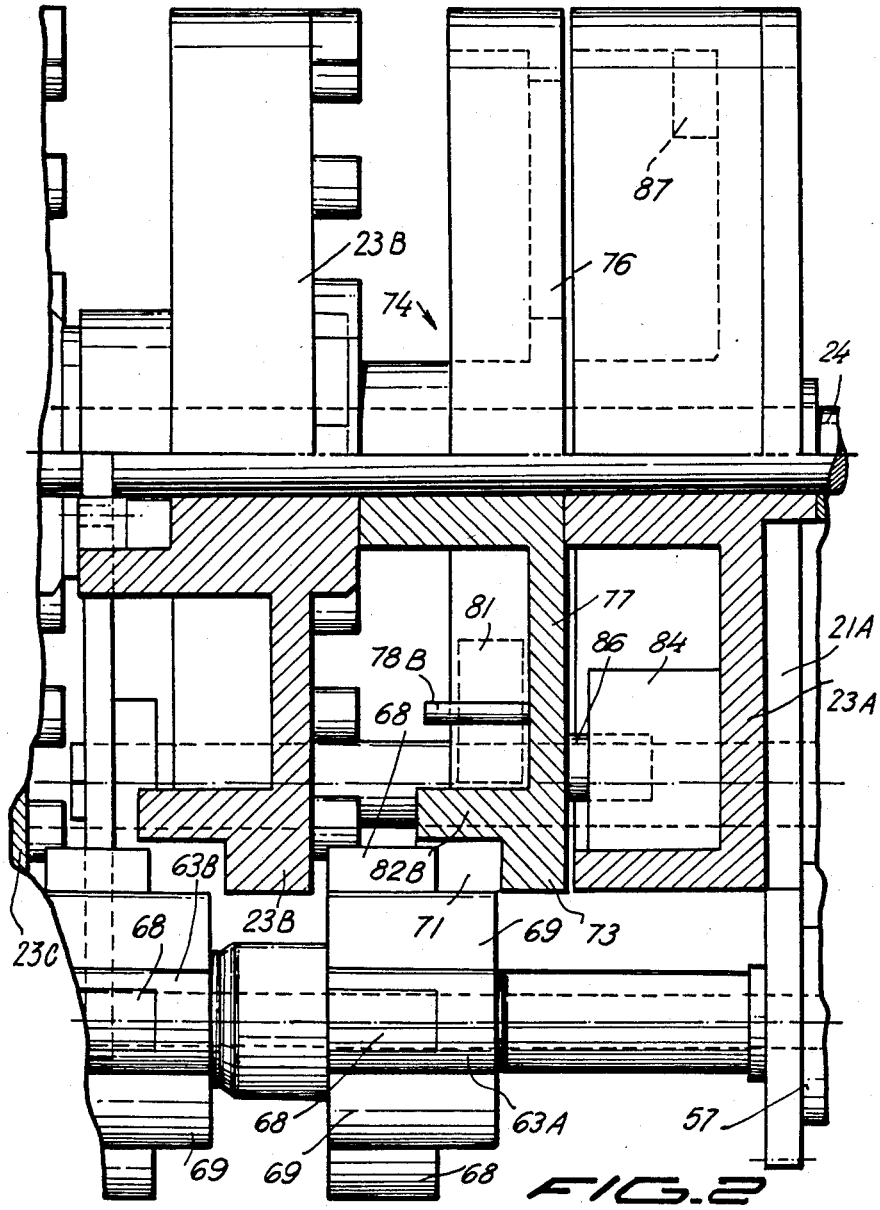
FIG. 2 is a longitudinal cross-section of the cyclometer register of FIG. 1.

Referring now also to FIG. 2, as is conventional, each carry pinion, 63A, 63B, etc. includes an alternating series of short and long teeth 68 and 69, respectively. Long teeth 69 extend along the entire axial length of their respective carry pinions. Short teeth 68 have a substantially shorter axial length for permanent engagement with their next most significant cyclometer drum. Short teeth 68 remain disengaged from their next less significant drum. Except during the 9-to-0 transition, long teeth 69 remain locked against the peripheral surfaces of their lower-significant cyclometer drums to avoid unwanted transitions of the higher-significance drum due, for example, to external vibration. During a carry, the next one of long teeth 69 enters a slot 71 which rotates into alignment therewith at the time for a carry. This unlocks the respective carry pinion and permits the carry operation to be performed.

The relative positions of tooth 84 and pin 86 are established to synchronize fly wheel 73 to perform its free rotation at the time for a carry. A striker 82 on fly wheel 73, comprising pins 82A and 82B affixed on opposing sides of slot 71, rotates into engagement with the next adjacent one of short teeth 68 on first pinion 63A. The kinetic energy of fly wheel 73 impels first pinion 63A toward completing the carry to driver drum 23B. At this time, slot 71 in fly wheel 73 is in position for penetration by the next one of long teeth 69 on first pinion 63A. This unjams first pinion 63A and pemits first pinion 63A and driver drum 23B to advance one increment of rotation. Once the carry is completed, slot 71 no longer aligns with one of long teeth 69, thus leaving first pinion 63A jammed until the completion of the next rotation of driver drum 23A.

FIG. 5 illustrates a face 83 of driver drum 23A facing fly wheel 73. Unlike the higher order drums, driver drum 23A has a single bolt or tooth 84 (shown also in FIG. 1) for impelling fly wheel 73 during half a turn thereof. A pin 86 located on a second side surface 75 (shown in FIG. 1) of fly wheel 73 has both the same radial and axial coordinates of tooth 84 to permit direct contact therebetween. During operation, while driver drum 23A travels from 5 to 9, tooth 84 pushes pin 86 thereby moving fly wheel 73 with it until pin 86 reaches its highest point. In this position, which coincides with the 9 to 0 transition of driver drum 23A, weight 81 of fly wheel 73 begins to rotate under the effect of its own inertia causing striker 82 to slam against first pinion 63A thereby incrementing the display of second drum 23B by one unit. During this transition, first pinion 63A sucessively transmits data to all remaining higher order drums, using the kinetic energy unloaded suddenly by fly wheel 73. This mechanism thus acts like a striker, storing energy during a time interval previous to discharging it practically instantaneously. This discharge is effected intermittently and automatically when the stored energy reaches a certain level, i.e. precisely when the driver drum 23A changes from 9 to 0.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A flip-over mechanism for a cyclometer register of a type including at least first and second cyclometer drums rotatable on a drum shaft and a carry pinion for incrementing said second cyclometer drum, comprising:

means for permitting said first cyclometer drum to be driven by an external device;

a fly-wheel on said drum shaft;

means on said fly-wheel for providing a predetermined amount of imbalance therein;

engaging means on said first cyclometer drum and said fly-wheel for concertedly rotating said fly-wheel by said first cyclometer drum during a predetermined portion of a rotation of said first cyclometer drum;

said engaging means including means for pemitting said fly wheel to perform a free forward rotation upon said shaft at a predetermined point in a rotation of said first cyclometer drum; and said fly-wheel including means for momentarily urging said carry pinion at an end of said free forward rotation whereby a substantially instantaneous carry is provided.

2. A flip-over mechanism according to claim 1 wherein said means for providing an imbalance includes at least one hole in said fly-wheel.

3. A flip-over mechanism according to claim 1 wherein said means for providing an imbalance includes means for pemitting the attachment of a weight to said fly-wheel.

4. A flip-over mechanism according to claim 3 wherein said means for attaching a weight includes at least one pin integrally formed in said fly-wheel and said weight includes a matching hole for fitting over said at least one pin.

5. A flip-over mechanism according to claim 4 wherein said weight includes a selectable weight of from about 3 to about 6 grams.

6. A flip-over mechanism according to claim 4 wherein said at least one pin is a thermoplastic and said at least one pin includes a heat rivetting at an outer end thereof effective for securing said weight to said fly-wheel.

7. A flip-over mechanism according to claim 1 wherein said engaging means includes a tooth on one of said first cyclometer drum and said fly-wheel and a pin on the other of said first cyclometer drum and said fly-wheel, said tooth and said pin being mutually disposed at a same radial distance from said drum shaft.

8. A flip-over mechanism according to claim 1 wherein said means for momentarily urging includes a striker on said fly-wheel.

9. A flip-over mechanism according to claim 8 wherein said striker includes first and second striker pins, said first and second striker pins being positioned to engage a tooth on said carry pinion.

10. A flip-over mechanism according to claim 9 wherein said means for momentarily urging further includes a slot in said fly wheel, said slot being effective to permit the entry therein of a tooth on said carry pinion whereby said carry pinion is momentarily unlocked.

11. A flip-over mechanism according to claim 10 wherein said first striker pin is disposed at a first side of said slot and said second pin is disposed at a second side of said slot.

* * * * *